US011131958B2

(12) United States Patent
Tanio et al.

(10) Patent No.: US 11,131,958 B2
(45) Date of Patent: Sep. 28, 2021

(54) IMAGE FORMING APPARATUS INCORPORATING TONER HOLDER DISMOUNTABLY MOUNTED IN BODY OF THE IMAGE FORMING APPARATUS

(71) Applicant: KYOCERA Document Solutions Inc., Osaka (JP)

(72) Inventors: Koji Tanio, Osaka (JP); Takashi Kusukawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/125,570

(22) Filed: Dec. 17, 2020

(65) Prior Publication Data

US 2021/0191309 A1 Jun. 24, 2021

(30) Foreign Application Priority Data

Dec. 23, 2019 (JP) ..... JP2019-231188

(51) Int. Cl.
*G03G 21/16* (2006.01)
*G03G 15/00* (2006.01)

(52) U.S. Cl.
CPC ..... *G03G 21/1647* (2013.01); *G03G 15/556* (2013.01); *G03G 21/1676* (2013.01)

(58) Field of Classification Search
CPC ..... G03G 15/0865; G03G 15/556; G03G 21/1647; G03G 21/1676; G03G 2221/163
See application file for complete search history.

(56) References Cited

U.S. PATENT DOCUMENTS

2010/0329704 A1 12/2010 Tachibana ..... 399/27
2011/0058825 A1* 3/2011 Tsukijima ..... G03G 21/1676 399/27
2017/0102637 A1* 4/2017 Seto ..... G03G 21/1676
2019/0302686 A1* 10/2019 Mochizuki ..... G03G 21/1647
2021/0003940 A1* 1/2021 Park ..... G03G 15/0865

FOREIGN PATENT DOCUMENTS

JP 2005-91462 A 4/2005
JP 2011-8142 A 1/2011

* cited by examiner

*Primary Examiner* — Sophia S Chen
(74) *Attorney, Agent, or Firm* — Stein IP, LLC

(57) ABSTRACT

An image forming apparatus includes an image carrying member, a developing device, a toner holder, a toner holder mount portion, and a locking member. The toner holder is dismountably mounted in the toner holder mount portion and stores toner for the developing device. The toner holder mount portion has a pair of side support rails supporting a side face of the toner holder. The locking member is adjacent to an end part, in the toner holder mounting direction, of at least one side support rail, and is swingable between a first position restraining mounting and dismounting of the toner holder and a second position allowing mounting and dismounting of the toner holder. The locking member, in the second position, is on the extension line of the side support rails and, together with the side support rails, guides the toner holder to and from the toner holder mount portion.

8 Claims, 10 Drawing Sheets

IMAGE FORMING APPARATUS INCORPORATING TONER HOLDER DISMOUNTABLY MOUNTED IN BODY OF THE IMAGE FORMING APPARATUS

INCORPORATION BY REFERENCE

This application is based on and claims the benefit of Japanese Patent Application No. 2019-231188 filed on Dec. 23, 2019, the contents of which are hereby incorporated by reference.

BACKGROUND

The present disclosure relates to image forming apparatuses that employ an electrophotographic process, such as copiers, printers, and facsimile machines. More particularly, the present disclosure relates to image forming apparatuses that incorporate a toner container which is dismountably mounted in the body of the image forming apparatus.

In known image forming apparatuses relying on electrophotography, it is common to sense toner concentration (or the amount of toner) in a developing device with a toner sensor to supply, as toner concentration (the amount of toner) diminishes, additional toner from a toner holder such as a toner container to the developing device.

In such image forming apparatuses, a toner holder is usually replaced with a new one when it becomes empty. Inconveniently, if a toner holder is replaceable with some toner still remaining in it, it may be disposed of despite being still usable with the toner remaining in it.

To cope with that, in a known image forming apparatus, whether the amount of remaining toner is sufficient is monitored based on the result of sensing of toner condition by a process cartridge condition monitoring controller so that, so long as the amount of remaining toner is found to be sufficient, the process cartridge is judged not to have reached the time for replacement yet, in which case a solenoid is turned off by a stopper controller so that the stopper function is enabled.

Another known image forming apparatus includes a locking means for locking a cover of a toner holder mounted; a sensing means for sensing depletion of toner in the toner holder mounted; and a displaying means for displaying on a display a screen for accepting, when the sensing means senses depletion of toner, input for performing replacement of the toner holder that has been sensed to be devoid of toner. In this image forming apparatus, in response to input being accepted via a screen displayed by the displaying means, the lock exerted by the locking means (a toner bottle cover) is released, and this permits replacement of the toner holder that has been sensed to be devoid of toner.

SUMMARY

According to one aspect of the present disclosure, an image forming apparatus includes an image carrying member, a developing device, a toner holder, a toner holder mount portion, and a locking member. On the image carrying member, an electrostatic latent image is formed. The developing device forms a toner image by attaching toner to the electrostatic latent image formed on the image carrying member. The toner holder that is dismountably mounted and stores toner to be supplied to the developing device. In the toner holder mount portion, the toner holder is mounted. The locking member restrains mounting and dismounting of the toner holder in and from the toner holder mount portion. The toner holder mount portion has a pair of side support rails that supports a side face of the toner holder. The locking member is arranged adjacent to an upstream end part, in the mounting direction of the toner holder, of at least one of the side support rails, and is swingable between a first position where the locking member is perpendicular to the extension direction of the side support rails and restrains mounting and dismounting of the toner holder and a second position where the locking member is parallel to the extension direction of the side support rails and permits mounting and dismounting of the toner holder. The locking member, when in the second position, is arranged on the extension line of the side support rails, and guides, together with the side support rails, the toner holder to and from the toner holder mount portion.

This and other objects of the present disclosure, and the specific benefits obtained according to the present disclosure, will become apparent from the description of embodiments which follows.

DETAILED DESCRIPTION

Figure 1:
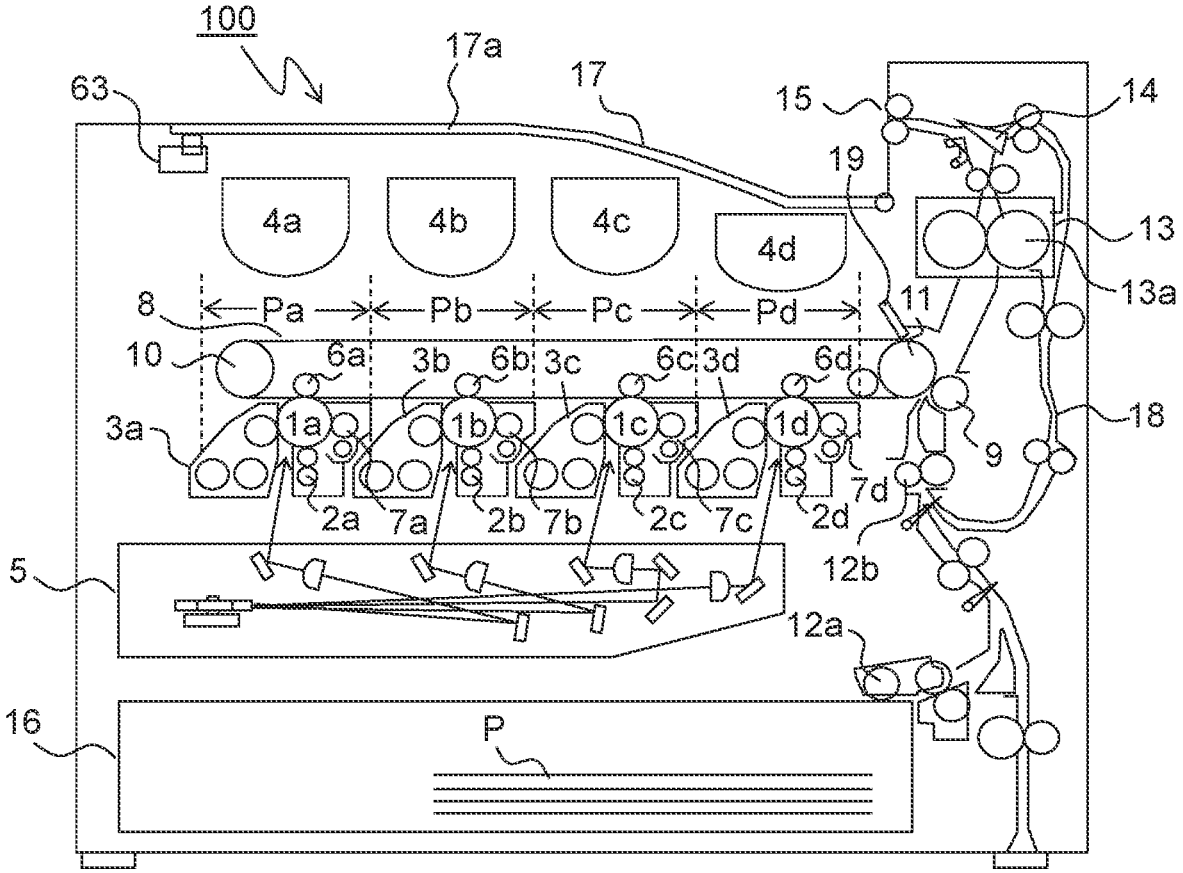
FIG. 1 is a schematic sectional view showing an overall construction of an image forming apparatus according to one embodiment of the present disclosure.

An embodiment of the present disclosure will be described below with reference to the accompanying drawings. FIG. 1 is a sectional view showing an internal construction of an image forming apparatus 100 according to one embodiment of the present disclosure. In the body of the image forming apparatus 100 (here, a color printer), four image forming portions Pa, Pb, Pc, and Pd are arranged in this order from upstream (in FIG. 1, the left side) in the conveying direction. These image forming portions Pa to Pd are provided to correspond to four different colors (cyan, magenta, yellow, and black), and respectively form a cyan, a magenta, a yellow, and a black image sequentially through the processes of charging, exposure, developing, and transfer.

In the image forming portions Pa to Pd, photosensitive drums (image carrying members) 1*a*, 1*b*, 1*c*, and 1*d* that carry visible images (toner images) of different colors are arranged. Also an intermediate transfer belt 8 that is driven by a belt driving motor 44 (see FIG. 4) to rotate counterclockwise in FIG. 1 is provided adjacent to the image forming portions Pa to Pd. The toner images formed on the photosensitive drums 1*a* to 1*d* are, by being primarily transferred sequentially to the intermediate transfer belt 8, which moves while in contact with the photosensitive drums 1*a* to 1*d*, overlaid on each other. Thereafter, the toner images primarily transferred to the intermediate transfer belt 8 are secondarily transferred by a secondary transfer roller 9 to a transfer sheet P as one example of a recording medium. The transfer sheet P having the toner images secondarily transferred to it then has the toner images fixed to it in a fixing portion 13, and is then discharged out of the body of the image forming apparatus 100. While the photosensitive drums 1*a* to 1*d* are rotated clockwise in FIG. 1, an image forming process is performed with respect to the photosensitive drums 1*a* to 1*d*.

Transfer sheets P to which toner images will eventually be secondarily transferred are stored inside a sheet cassette 16 arranged in a lower part of the body of the image forming apparatus 100. A transfer sheet P is conveyed via a sheet feed roller 12*a* and a pair of registration rollers 12*b* to the nip between the secondary transfer roller 9 and a driving roller 11 for the intermediate transfer belt 8. Used as the intermediate transfer belt 8 is a sheet of a dielectric resin, typically a belt with no seam (a seamless belt). Downstream of the secondary transfer roller 9, a blade-form belt cleaner 19 for removing toner and the like left on the surface of the intermediate transfer belt 8 is provided.

Next, the image forming portions Pa to Pd will be described. Around and under the photosensitive drums 1*a* to 1*d*, which are arranged rotatably, there are provided charging device 2*a*, 2*b*, 2*c*, and 2*d* which electrostatically charge the photosensitive drums 1*a* to 1*d*, an exposure device 5 which exposes the photosensitive drums 1*a* to 1*d* to light conveying image information, developing device 3*a*, 3*b*, 3*c*, and 3*d* which form toner images on the photosensitive drums 1*a* to 1*d*, and cleaning devices 7*a*, 7*b*, 7*c*, and 7*d* which remove developer (toner) and the like left on the photosensitive drums 1*a* to 1*d*.

When image data is fed in from a host device such as a personal computer, first, the charging devices 2*a* to 2*d* electrostatically charge the surfaces of the photosensitive drums 1*a* to 1*d* uniformly. Next, the exposure device 5 radiates light based on the image data so that electrostatic latent images based on the image data are formed on the photosensitive drums 1*a* to 1*d*. The developing devices 3*a* to 3*d* are loaded with predetermined amounts of two-component developer containing cyan, magenta, yellow, and black toner respectively. When, as toner images are formed as will be described later, the proportion of toner in the two-component developer in the developing devices 3*a* to 3*d* falls below a prescribed value, fresh toner is additionally fed from toner containers 4*a* to 4*d* to the developing devices 3*a* to 3*d*. The toner in the developer is supplied by the developing devices 3*a* to 3*d* onto, so as to electrostatically attach to, the photosensitive drums 1*a* to 1*d*. In this way, toner images that correspond to the electrostatic latent images formed by exposure to light from the exposure device 5 are formed on the photosensitive drums 1*a* to 1*d*.

Primary transfer rollers 6*a* to 6*d* produce an electric field with a predetermined transfer voltage between the primary transfer rollers 6*a* to 6*d* and the photosensitive drums 1*a* to 1*d* so that the cyan, magenta, yellow, and black toner images on the photosensitive drums 1*a* to 1*d* are primarily transferred to the intermediate transfer belt 8. These images of four colors are formed in a prescribed predetermined positional relationship with each other so as to form a predetermined full-color image. Thereafter, in preparation for the subsequent formation of new electrostatic latent images, the toner and the like that are left on the surfaces of the photosensitive drums 1*a* to 1*d* after primary transfer are removed by the cleaning devices 7*a* to 7*d*.

The intermediate transfer belt 8 is stretched around a driven roller 10, located upstream, and a driving roller 11, located downstream. When, as the driving roller 11 rotates by being driven by a belt driving motor 44 (see FIG. 4), the intermediate transfer belt 8 starts to move around counterclockwise, a transfer sheet P is conveyed, with predetermined timing, from the pair of registration rollers 12*b* to the nip (secondary transfer nip) between the driving roller 11 and the secondary transfer roller 9, the latter being provided adjacent to the former, with the result that the full-color image on the intermediate transfer belt 8 is secondarily transferred to the transfer sheet P. The transfer sheet P having the toner images secondarily transferred to it is conveyed to the fixing portion 13.

The transfer sheet P conveyed to the fixing portion 13 is heated and pressed by a pair of fixing rollers 13*a* so that the toner images are fixed to the surface of the transfer sheet P, thereby forming the predetermined full-color image. The transfer sheet P having the full-color image formed on it has its conveying direction switched by a branch portion 14 branching into a plurality of directions so as to be discharged as it is (or after being fed into a duplex passage 18 and subjected to duplex printing) onto a discharge tray 17 by a pair of discharge rollers 15.

On the top face of the image forming apparatus 100, a top cover 17*a*, which forms part of the discharge tray 17, is provided. With the top cover 17*a* open, the toner containers 4*a* to 4*d* are mounted in the body of the image forming apparatus 100, or are taken out of the body of the image forming apparatus 100. Near the swinging end (the left end in FIG. 1) of the top cover 17*a*, there is arranged an open-close sensing switch 63 for sensing whether the top cover 17*a* is open or closed.

Figure 2:
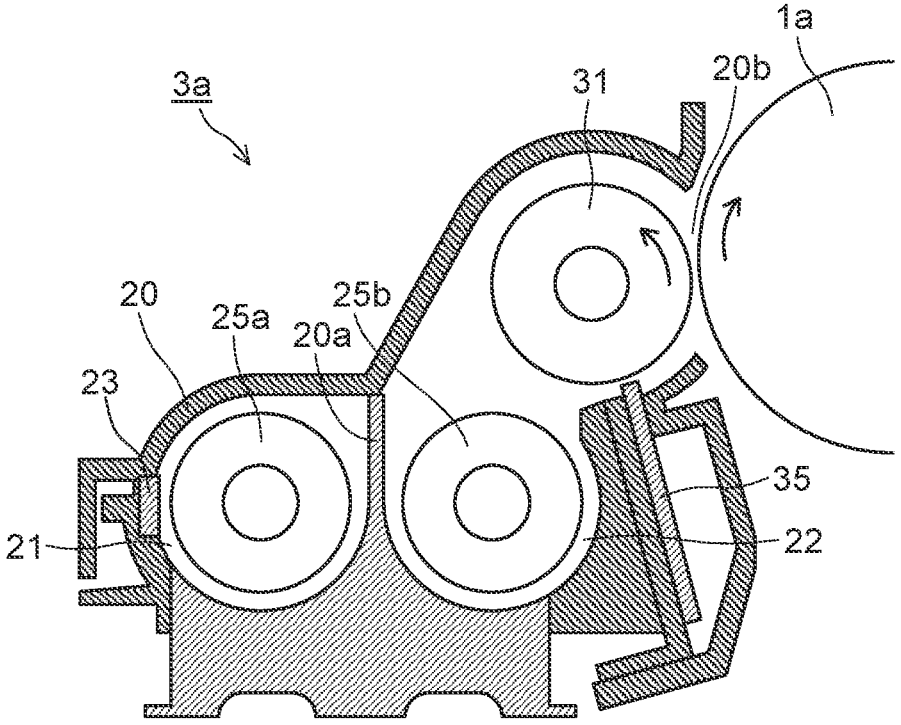
FIG. 2 is a side sectional view of a developing device incorporated in the image forming apparatus according to the embodiment.

FIG. 2 is a side sectional view of the developing device 3*a* incorporated in the image forming apparatus 100. While the following description deals with, as an example, the developing device 3*a* arranged in the image forming portion Pa in FIG. 1, the developing devices 3*b* to 3*d* arranged in the image forming portions Pb to Pd have basically the same structure, and therefore no overlapping description will be repeated.

As shown in FIG. 2, the developing device 3*a* has a developer holder 20 in which two-component developer (hereinafter referred to simply as developer) containing magnetic carrier and toner is stored. The developer holder 20 is divided into a stirring-conveying chamber 21 and a feeding-conveying chamber 22 by a partition wall 20*a*. In the stirring-conveying chamber 21 and the feeding-conveying chamber 22 respectively, there are rotatably arranged a stirring-conveying screw 25*a* and a feeding-conveying screw 25*b* for mixing the toner fed from the toner container 4*a* (see FIG. 1) with magnetic carrier and stirring and electrostatically charging the toner.

The developer is conveyed, while being stirred, by the stirring-conveying screw 25*a* and the feeding-conveying screw 25*b* in the axial direction (in the direction perpendicular to the plane of FIG. 2), and circulates between the stirring-conveying chamber 21 and the feeding-conveying chamber 22 through unillustrated developer passages formed in opposite end parts of the partition wall 20*a*. That is, the stirring-conveying chamber 21, the feeding-conveying chamber 22, and the developer passages form a circulation passage for developer inside the developer holder 20.

The developer holder 20 extends diagonally up rightward in FIG. 2, and inside the developer holder 20, a developing roller 31 is arranged diagonally to the upper right of the feeding-conveying screw 25*b*. Part of the outer circumferential face of the developing roller 31 is exposed through an opening 20*b* in the developer holder 20 to face the photosensitive drum Ia. The developing roller 31 rotates counterclockwise in FIG. 2.

In the conveying chamber 21, a toner concentration sensor 23 is arranged opposite the stirring-conveying screw 25*a*. Used as the toner concentration sensor 31 is a magnetic permeability sensor that senses the magnetic permeability of the two-component developer inside the developer holder 20. Here, toner concentration refers to the ratio (TIC) of toner to magnetic carrier in developer. In the embodiment, the magnetic permeability of developer is sensed by the toner concentration sensor 23, and a voltage value that reflects the result of the sensing is fed to a control portion 90 (see FIG. 4), which will be described later. Then in the control portion 90, the toner concentration is determined based on the output value of the toner concentration sensor 23. According to the determined toner concentration, the control portion 90 feeds a control signal to a toner feed motor 27 (see FIGS. 3 and 4) to supply a predetermined amount of toner into the developer holder 20.

The output value of the toner concentration sensor 23 varies with the toner concentration. Specifically, the higher the toner concentration, the higher the ratio of toner to magnetic carrier, resulting in an increased proportion of toner, which is impermeable to magnetism, and hence a lower output value; the lower the toner concentration, the lower the ratio of toner to magnetic carrier, resulting in an increased proportion of magnetic carrier, which is permeable to magnetism, and hence a higher output value.

The developing roller 31 is composed of a developing sleeve, which is cylindrical and which rotates counterclockwise in FIG. 2, and a magnet (not illustrated) with a plurality of magnetic poles, which is fixed inside the developing sleeve. A developing voltage that has an alternating-current voltage Vslv(AC) superposed on a direct-current voltage Vslv(DC) by a developing voltage power source 53 (see FIG. 4) is applied to the developing roller 31.

In the developer holder 20, a restricting blade 35 is fitted along the lengthwise direction (the direction perpendicular to the plane of FIG. 2) of the developing roller 31. Between a tip end part of the restricting blade 35 and the surface of the developing roller 31, there is formed a small interval (gap).

Figure 3:
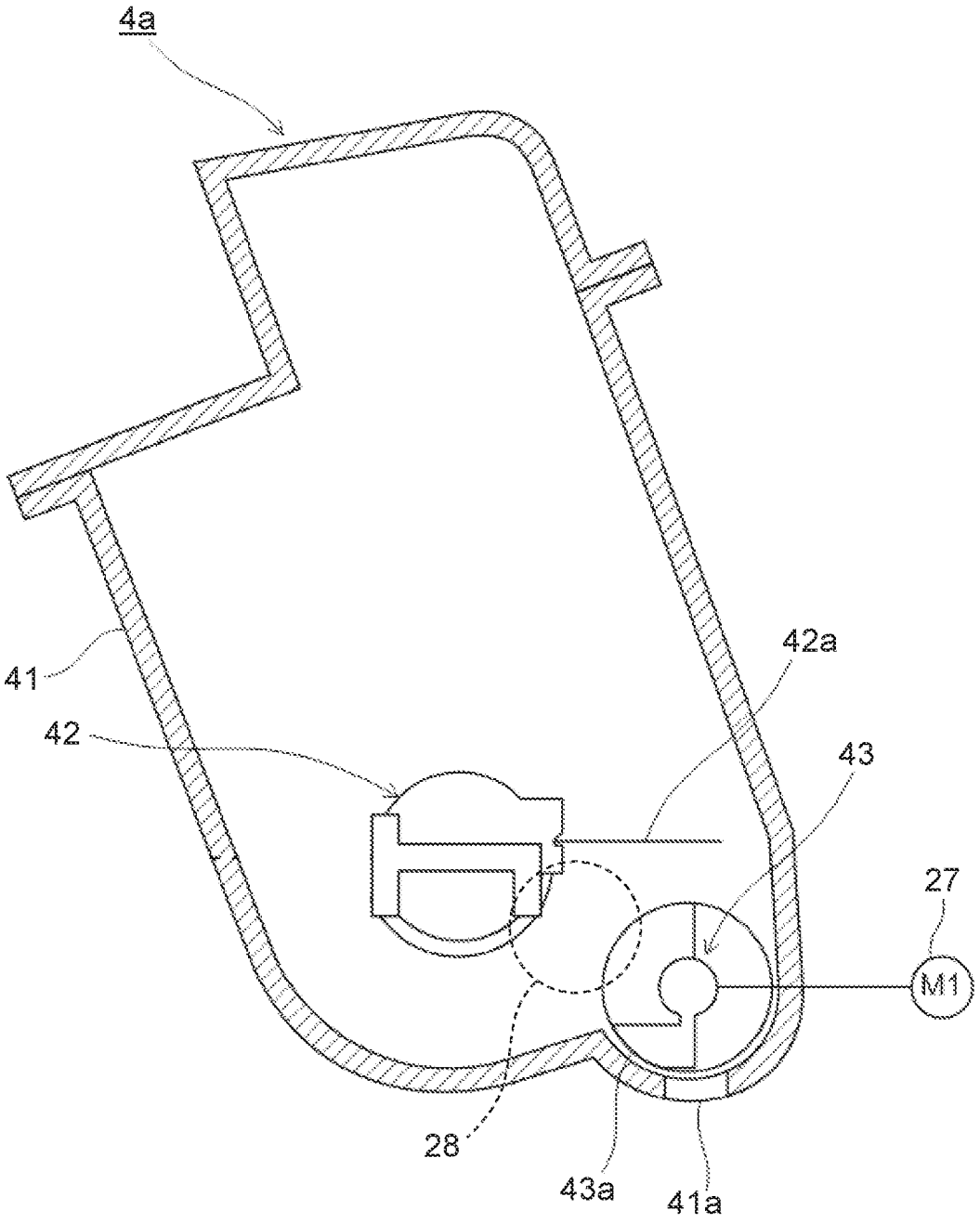
FIG. 3 is a side sectional view of a toner container incorporated in the image forming apparatus according to the embodiment.

FIG. 3 is a side sectional view of a toner container 4*a* incorporated in the image forming apparatus 100. While the following description deals with, as an example, the toner container 4*a* that supplies toner to the developing device 3*a*, the toner containers 4*b* to 4*d* that supply toner to the developing devices 3*b* to 3*d* have basically the same structure, and therefore no overlapping description will be repeated. The toner container 4*a* includes a container casing 41 in which fresh toner is stored, a stirring paddle 42, and a conveying screw 43.

In one end part of a bottom part of the container casing 41 in its longitudinal direction (the direction perpendicular to the plane of FIG. 3), there is formed a feed port 41*a* which is connected to a toner supply port (not illustrated) of the developer holder 20. The stirring paddle 42 has a stirring blade 42*a* that protrudes from a rotary shaft to one side in a radial direction and that extends in the longitudinal direction of the container casing 41. As the stirring blade 42*a* rotates, the toner inside the container casing 41 is stirred, and the stirred toner is conveyed toward the conveying screw 43.

The conveying screw 43 has, around a rotary shaft, a helical blade 43*a* that is formed in the shape of a helix with a predetermined phase (pitch) in the longitudinal direction, and is arranged opposite the feed port 41*a* in a bottom part inside the container casing 41. As the conveying screw 43 rotates, the toner stirred by the stirring paddle 42 is conveyed toward the feed port 41*a* while the phase of the helical blade 43*a* advances, and is supplied via the feed port 41*a* into the developer holder 20. The stirring blade 42*a* of the stirring paddle 42 protrudes in a radial direction to reach the outer edge of the conveying screw 43, and can be brought into contact with the helical blade 43*a*.

To the conveying screw 43, a toner supply motor 27 is connected. The toner supply motor 27 is a DC motor that makes the conveying screw 43 rotate, and is driven to rotate, for example, as a result of a pulse voltage applied to a bridge circuit being turned on and off repeatedly. Outside the container casing 41, an idle gear 28 that is coupled to the conveying screw 43 and to the stirring paddle 42 is arranged. The rotation driving force fed to the conveying screw 43 by the toner supply motor 27 is transmitted via the idle gear 28 to the stirring paddle 42, which thus rotates.

With a sufficient amount of toner stored in the container casing 41, the stirring paddle 42 stirs toner and supplies it to the conveying screw 43. As the toner supply motor 27 rotates at a constant speed, the conveying screw 43 supplies a predetermined amount of toner commensurate with the rotation speed via the feed port 41*a* into the developer holder 20. Thus the toner concentration inside the developer holder 20 is kept constant. If, despite toner being supplied, the toner concentration in the developer inside the developer holder 20 as detected by the toner concentration sensor 23 (see FIG. 2) does not rise, the control portion 90 judges that the toner container 4*a* is empty of toner. The control portion 90 indicates on a liquid crystal display portion 61 (see FIG. 4) that no toner remains in the toner container 4*a* (hereinafter referred to "toner depletion"), and prompts the user to replace the toner container 4*a*.

If toner depletion is indicated suddenly, in a case where preparation of a replacement toner container 4*a* takes time, the user may be left unable to use the image forming apparatus 100 for a while. To avoid that, before toner depletion is indicated, a state of near-depletion of toner (hereinafter referred to as "near-depletion") is recognized and is indicated on the liquid crystal display portion 61 so that, when near-depletion is indicated, the user can make time for the preparation of a replacement toner container 4*a*.

The speed of supply of toner from the toner container 4*a* is constant so long as a sufficient amount of toner remains in the toner container 4*a* However, as the amount of toner in the toner container 4*a* diminishes, the speed of supply decreases. In view of this, when the amount of toner supplied from the toner container 4*a* per unit time has diminished to a predetermined amount, near-depletion is indicated, and when the amount of toner supplied diminishes further, toner depletion is indicated. Near-depletion can be detected, like toner depletion, based on the toner concentration in the developer inside the developer holder 20 as sensed by the toner concentration sensor 23, or can be predicted based on the toner coverage ratio calculated from the image signal of the images printed.

Figure 4:
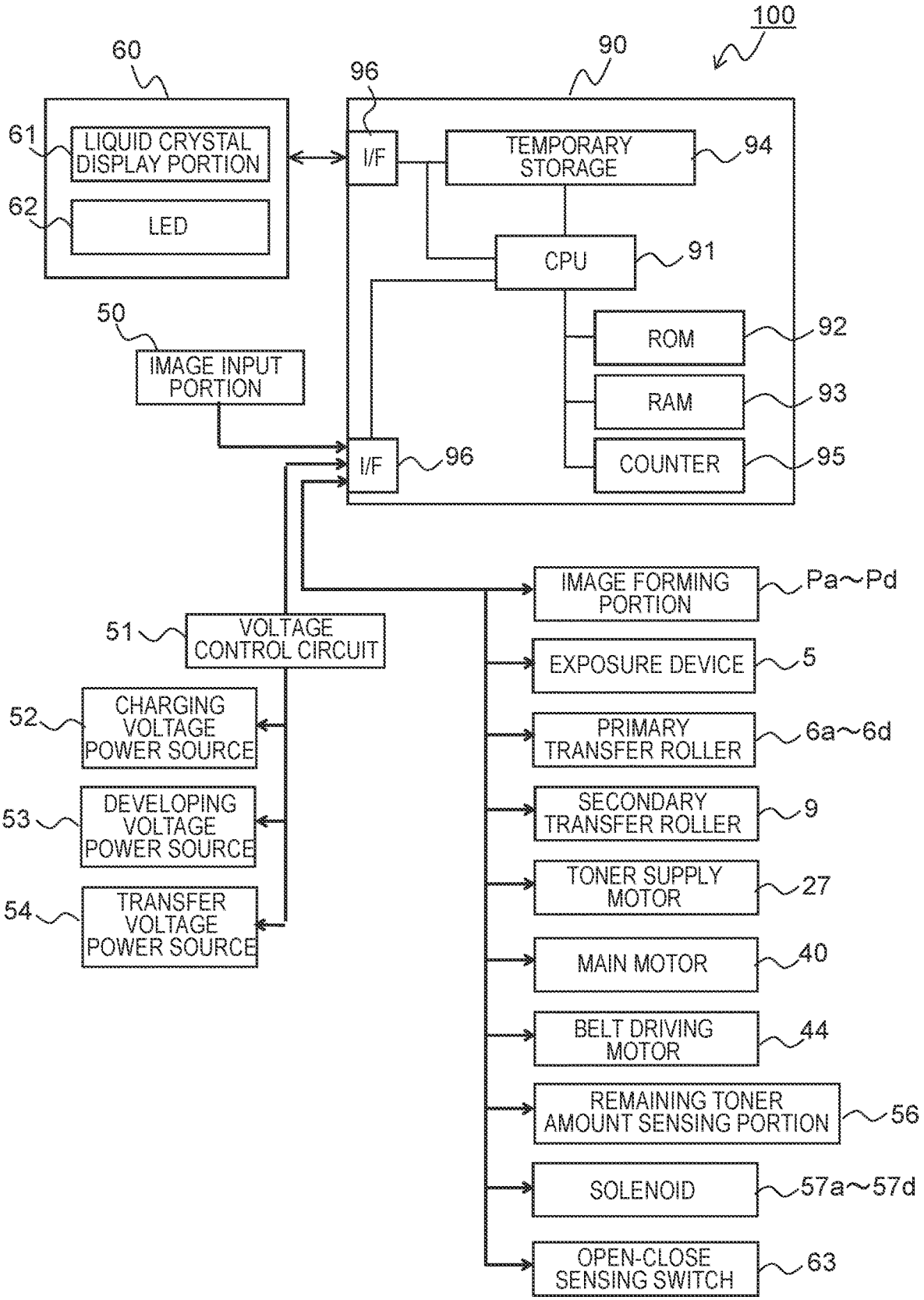
FIG. 4 is a block diagram showing one example of control paths in the image forming apparatus according to the embodiment.

FIG. 4 is a block diagram showing one example of control paths used in an image forming apparatus 100 according to the present disclosure. It should be noted that, as various kinds of control are performed on different parts of the image forming apparatus 100 during its use, the image forming apparatus 100 as a whole has complicate control paths. The following description however focuses on those control paths which are needed to implement the present disclosure.

The control portion 90 at least includes a CPU (central processing unit) 91 as a central arithmetic processor, a ROM (read-only memory) 92 which is a storage for reading-out only, a RAM (random-access memory) 93 which is a storage for both reading-out and writing-to, a temporary storage 94 for temporarily storing image data and the like, a counter 95, and a plurality of (here, two) I/Fs (interfaces) 96 for transmitting control signals to different devices within the image forming apparatus 100 and for receiving input signals from an operation portion 60.

The ROM 92 stores control programs for the image forming apparatus 100, values and the like necessary for control, data that remains unchanged during the use of the image forming apparatus 100, and the like. The RAM 93 stores necessary data generated in the course of controlling the image forming apparatus 100, data temporarily needed for controlling the image forming apparatus 100, and the like. The counter 95 counts the number of printed sheets on a cumulative basis.

The control portion 90 transmits control signals from the CPU 91 via the I/Fs 96 to different parts and devices in the image forming apparatus 100. From those different parts and devices, signals indicating their states and input signals are transmitted via the I/Fs 96 to the CPU 91. The different parts and devices controlled by the control portion 90 include, for example, the image forming portions Pa to Pd, the exposure device 5, the primary transfer rollers 6*a* to 6*d*, the secondary transfer roller 9, the toner supply motor 27, a main motor 40, the belt driving motor 44, an image input portion 50, a voltage control circuit 51, a remaining toner amount sensing portion 56, solenoids 57*a* to 57*d*, the operation portion 60, the open-close sensing switch 63, and the like.

The main motor 40 drives, to make rotate, the photosensitive drums 1*a* to 1*d*, the stirring-conveying screw 25*a*, the feeding-conveying screw 25*b*, the developing roller 31 in the developing devices 3*a* to 3*d*, and the like.

The image input portion 50 is a reception portion that receives image data transmitted from a personal computer or the like to the image forming apparatus 100. An image signal fed in via the image input portion 50 is converted into a digital signal and is then fed to the temporary storage 94.

The voltage control circuit 51 is connected to a charge voltage power source 52, a developing voltage power source 53, and a transfer voltage power source 54, and makes these power sources operate according to output signals from the control portion 90. In accordance with control signals from the voltage control circuit 51, the charge voltage power source 52 applies a predetermined voltage to charging rollers (not illustrated) in the charging devices 2*a* to 2*d*, the developing voltage power source 53 applies a predetermined voltage to developing rollers 31 in the developing devices 3*a* to 3*d*, and the transfer voltage power source 54 applies a predetermined voltage to the primary transfer rollers 6*a* to 6*d* and the secondary transfer roller 9.

The remaining toner amount sensing portion 56 includes the toner concentration sensor 23 (see FIG. 2) and the like, and senses whether the remaining toner amount in the toner containers 4*a* to 4*d* is above a predetermined threshold value. Specifically, if, after toner is suppled, the output value of the toner concentration sensor 23 does not fall, or reaches a predetermined threshold value set by the user, the toner containers 4*a* to 4*d* are judged to be close to empty, and near-depletion is indicated on the liquid crystal display portion 61. Specifically, a message indicating that the time for replacement of the toner containers 4*a* to 4*d* is close at hand (for example, a message like "Toner will run out soon") is displayed.

When, as toner is consumed further, the output value of the toner concentration sensor 23 rises until it reaches the predetermined threshold value, the toner containers 4*a* to 4*d* are judged to be empty, and toner depletion is indicated on the liquid crystal display portion 61. Specifically, a message indicating that the time for replacement of the toner containers 4*a* to 4*d* has come (for example, a message like "Toner has run out; please replace the containers") is displayed.

The solenoids 57*a* to 57*d* constitute a lock release driving portion 80 (see FIG. 9), and drive (make swing) locking members 71*a* to 71*d* (see FIG. 6), which are provided in a container mount portion 70, individually to release the toner containers 4*a* to 4*d* from a locked state.

The operation portion 60 includes the liquid crystal display portion 61 and LEDs 62 that indicate various states. The user operates a stop/clear button on the operation portion 60 to stop image formation, and operates a reset button to turn the various settings of the image forming apparatus 100 back to the default settings. The liquid crystal display portion 61 displays the state of the image forming apparatus 100, the status of image formation, the number of sheets printed, and remaining toner information such as "near-depletion" and "toner depletion". Various settings on the image forming apparatus 100 are made from a printer driver on the personal computer.

Figure 5:
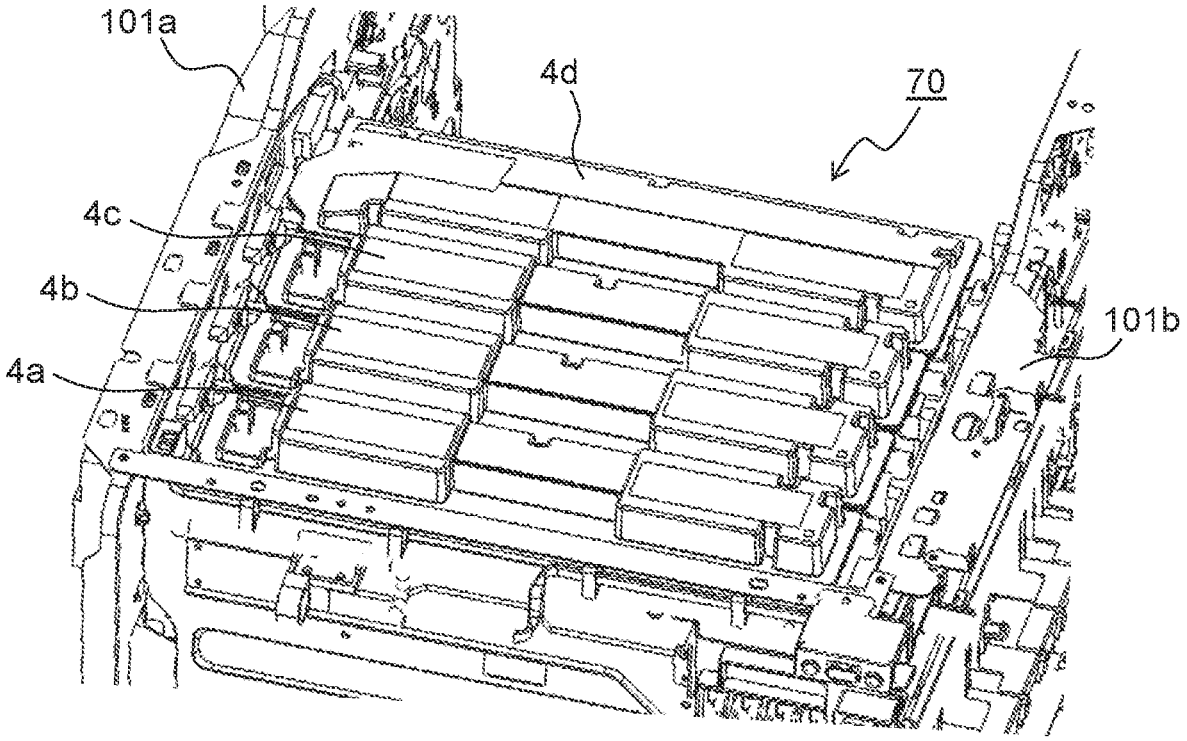
FIG. 5 is a perspective view of the image forming apparatus with a top cover open, as seen from above.
Figure 6:
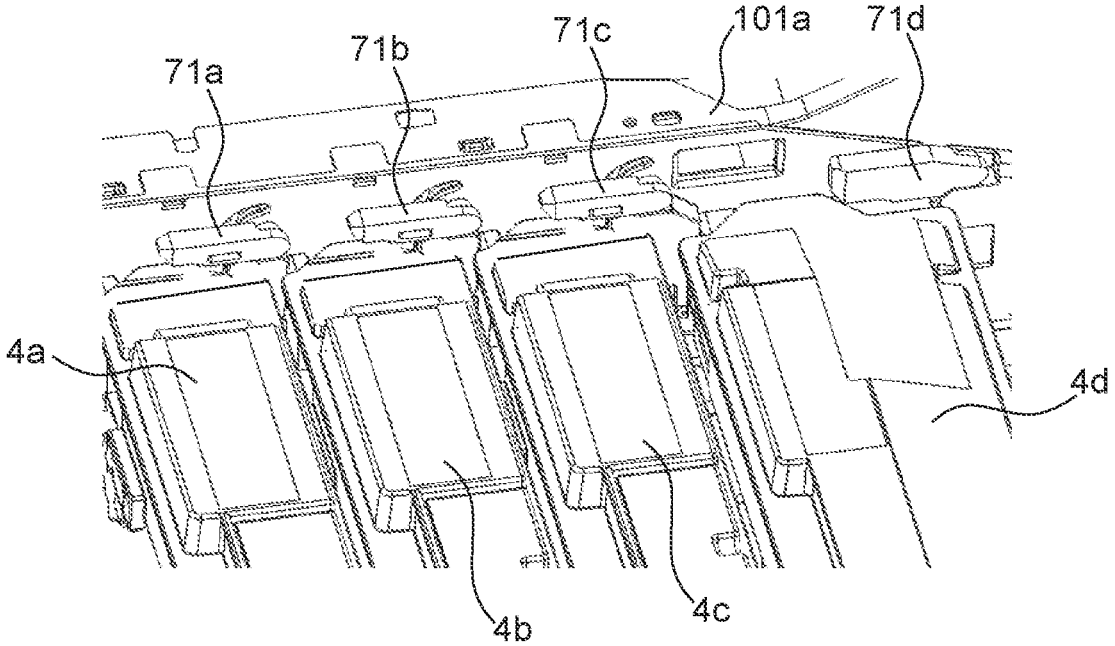
FIG. 6 is an enlarged part view around locking members for the toner containers in FIG. 5.

FIG. 5 is a perspective view of the image forming apparatus 100 with the top cover 17*a* open, as seen from above. FIG. 6 is an enlarged part view around the locking members 71*a* to 71*d* for the toner containers 4*a* to 4*d* in FIG. 5 (around a left end part in FIG. 5). As shown in FIG. 5, inside the top cover 17*a* (see FIG. 1), a container mount portion 70 is provided.

The container mount portion 70 supports the toner containers 4*a* to 4*d* at their opposite ends as if bridging between a rear frame 101*a* and a front frame 101*b* of the image forming apparatus 100, and permits the toner containers 4*a* to 4*d* to be mounted and dismounted from above. The container mount portion 70 includes locking members 71*a* to 71*d* that lock one end parts (in FIG. 5, left end parts) of the toner containers 4*a* to 4*d* in their longitudinal direction.

Figure 7:
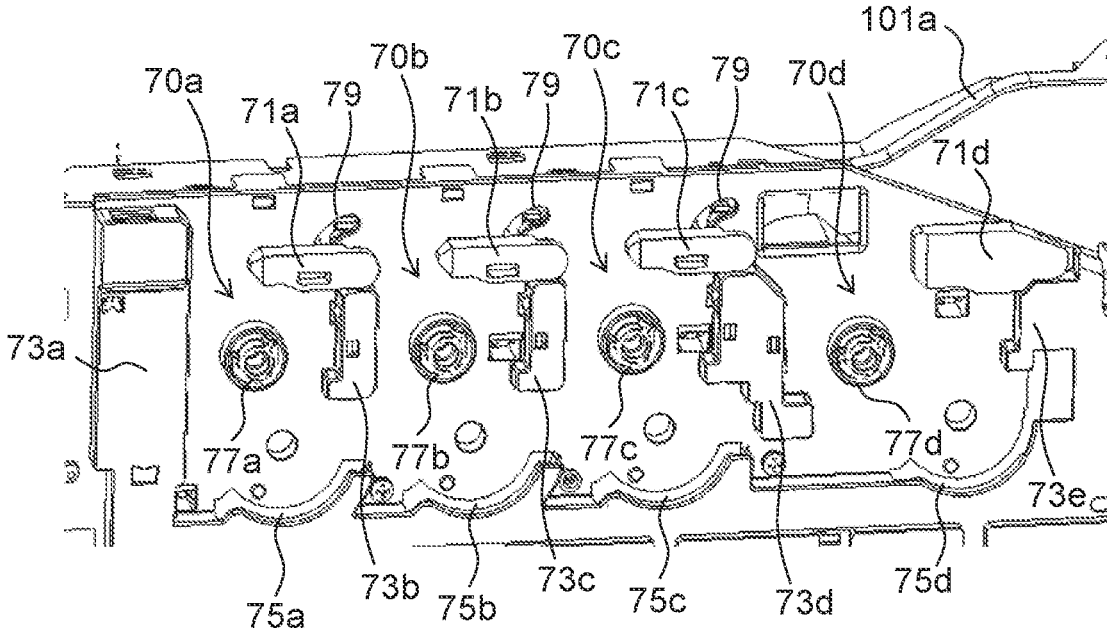
FIG. 7 is a perspective view showing a structure of a toner container mount portion at its rear frame side, showing a locked state achieved by the locking members.
Figure 8:
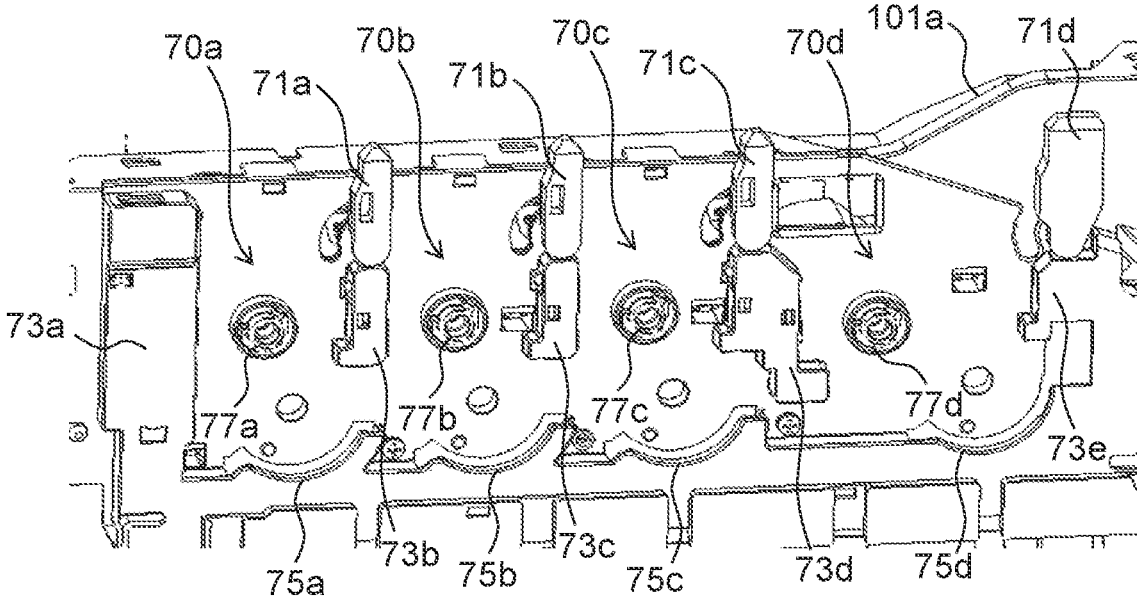
FIG. 8 is a perspective view showing the structure of the toner container mount portion at its rear frame side, showing an unlocked state achieved by the locking members.

FIGS. 7 and 8 are perspective views showing a structure of the container mount portion 70 at its rear frame 101*a* side, respectively showing a locked state and an unlocked state achieved by the locking members 71*a* to 71*d*.

As shown in FIG. 7, on the rear frame 101*a*, there are provided side support rails 73*a* to 73*e* which support the side faces of the toner containers 4*a* to 4*d* and bottom support portions 75*a* to 75*d* which support the bottom faces of the toner containers 4*a* to 4*d*. The part surrounded by a pair of side support rails 73*a* and 73*b* and a bottom support portion 75*a* serves as a first mount portion 70*a* in which the toner container 4*a* is mounted.

Likewise, the part surrounded by a pair of side support rails 73*b* and 73*c* and a bottom support portion 75*b*, the part surrounded by a pair of side support rails 73*c* and 73*d* and a bottom support portion 75*c*, and the part surrounded by a pair of side support rails 73*d* and 73*e* and a bottom support portion 75*d* respectively serve as a second to a fourth mount portion 70*b* to 70*d* in which the toner containers 4*b* to 4*d* are mounted.

In middle parts of the first to fourth mount portions 70*a* to 70*d*, there are arranged drive-side couplings 77*a* to 77*d* which feed the rotation driving force of the toner supply motor 27 (see FIGS. 3 and 4) to the conveying screw 43 (see FIG. 3) in the toner containers 4*a* to 4*d*. The locking members 71*a* to 71*d* are arranged adjacent to top end parts of the side support rails 73*b* to 73*e* respectively.

Though not illustrated, at opposite positions on the front frame 101*b*, there are arranged a first to a fourth mount portion 70*a* to 70*d* which include side support rails 73*a* to 73*e* and bottom support portions 75*a* to 75*d*. On the first to fourth mount portions 70*a* to 70*d* on the front frame 101*b*, stoppers 85 (see FIG. 10) are provided instead of locking members 71*a* to 71*d*.

The locking members 71*a* to 71*d* are swingable between a position (first position) in which they are perpendicular to the extension direction (the up-down direction) of the side support rails 73*a* to 73*e* indicated in FIG. 7 and a position (second position) in which they are parallel to the extension direction (the up-down direction) of the side support rails 73*a* to 73*e* indicated in FIG. 8. The locking members 71*a* to 71*d* swing between the first and second positions along the rear frame 101*a*. This keeps the locking members 71*a* to 71*d* supported on the rear frame 101*a* over their entire swing range, and allows stable swinging of the locking members 71*a* to 71*d*.

The locking members 71*a* to 71*d* being in the first position constitutes a locked state where dismounting of the toner containers 4*a* to 4*d* is restrained. The locking members 71*a* to 71*d* being in the second position constitutes an unlocked state where dismounting of the toner containers 4*a* to 4*d* is allowed. The locking members 71*a* to 71*d* are each swung between the first and second positions individually by a lock release driving portion 80 (see FIG. 9).

Figure 9:
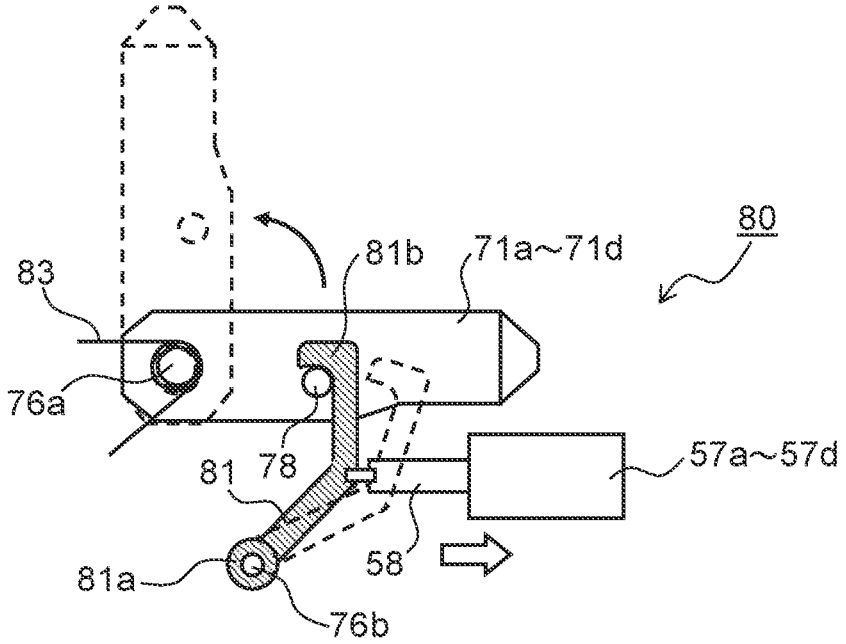
FIG. 9 is a diagram showing a lock release driving portion of a locking member, as seen from the rear side in FIG. 7.

FIG. 9 is a diagram showing the lock release driving portion 80 of the locking members 71*a* to 71*d* as seen from the rear side in FIG. 7. The structure of the lock release driving portion 80 is the same for the locking members 71*a* to 71*d*, and accordingly it will here be described with reference to a single diagram. The lock release driving portion 80 includes a solenoid 57*a* to 57*d*, a link member 81, and a torsion spring 83.

The locking member 71*a* to 71*d* is supported swingably about a first pivot 76*a* as a swinging pivot formed on the rear frame 101*a*. The first pivot 76*a* is fitted with the torsion spring 83 so as to bias the locking member 71*a* to 71*d* toward the second position (counter-clockwise in FIG. 9). On the side face of the locking member 71*a* to 71*d*, an engagement projection 78 is provided. The engagement projection 78 is provided at a position away from the first pivot 76*a* toward a tip end part, and engages with an arc-form guide hole 79 (see FIG. 7) formed in the rear frame 101*a*. This restricts the swinging range of the locking member 71*a* to 71*d* between the first and second positions.

A link member 81 has a bearing portion 81*a* and a hook portion 81*b*. The bearing portion 81*a* rotatably engages with a second pivot 76*b* formed on the rear frame 101*a*. The hook portion 81*b* is formed at the swinging end of the link member 81, and engages with the engagement projection 78 on the locking member 71*a* to 71*d*. To a bent part between the bearing portion 81*a* and the hook portion 81*b*, a plunger 58 of the solenoid 57*a* to 57*d* is coupled.

With the toner containers 4*a* to 4*d* mounted in the first to fourth mount portions 70*a* to 70*d*, the hook portion 81*b* of the link member 81 is engaged with the engagement projection 78 on the locking member 71*a* to 71*d*, and the locking member 71*a* to 71*d* is held in the first position (indicated by solid lines in FIG. 9) against the biasing force of the torsion spring 83.

When the solenoid 57*a* to 57*d* is energized, the plunger 58 is pulled into the solenoid 57*a* to 57*d*, and the link member 81, which is coupled to the plunger 58, swings clockwise. This results in the hook portion 81*b* being disengaged from the engagement projection 78, and thus the locking member 71*a* to 71*d* moves to the second position (indicated by broken lines in FIG. 9) under the biasing force of the torsion spring 83.

When the solenoid 57*a* to 57*d* is deenergized, the plunger 58 is pushed out of the solenoid 57*a* to 57*d*; thus the link member 81 swings counter-clockwise and moves back to the position where it can engage with the engagement projection 78. In this state, pressing the locking member 71*a* to 71*d* downward against the biasing force of the torsion spring 83 causes the engagement projection 78 to engage with the hook portion 81*b*, and thus the locking member 71*a* to 71*d* is kept in the first position.

Figure 10:
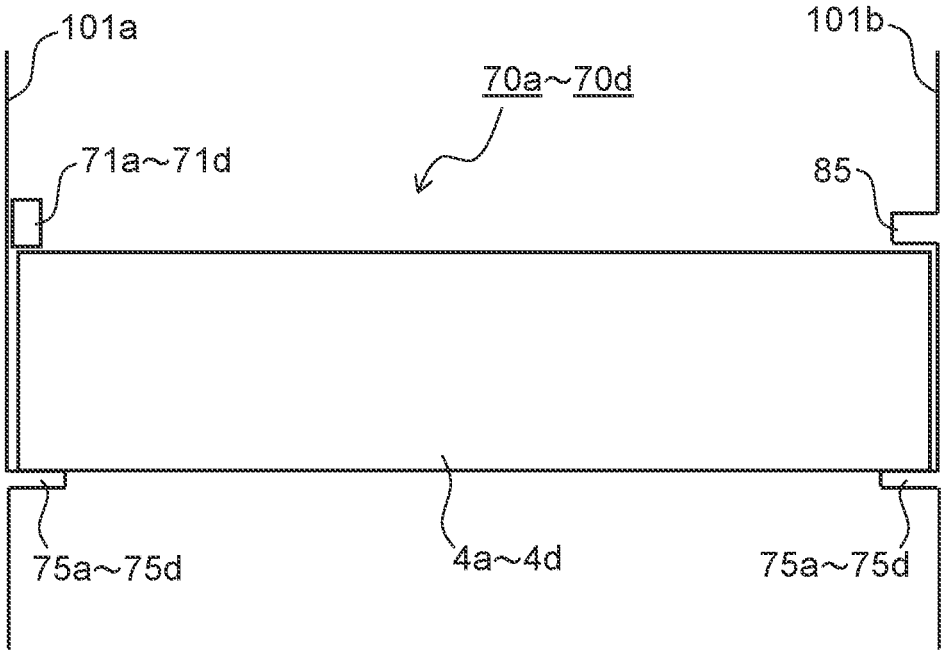
FIG. 10 is a side view schematically showing first to fourth mount portions of the container mount portion with toner containers mounted in them.

FIG. 10 is a side view schematically showing a state where the toner containers 4*a* to 4*d* are amounted in the first to fourth mount portions 70*a* to 70*d* in the container mount portion 70. How the toner containers 4*a* to 4*d* are mounted is the same for the first to fourth mount portions 70*a* to 70*d*, and accordingly it will here be described with reference to a single diagram.

As shown in FIG. 10, one end portion (right end portion in FIG. 10) of the toner container 4*a* to 4*d* is held between the bottom support portion 75*a* to 75*d* and the stopper 85 on the front frame 101*b*. An other end portion (left end portion in FIG. 10) of the toner container 4*a* to 4*d* is held between the bottom support portion 75*a* to 75*d* and the locking member 71*a* to 71*d* on the rear frame 101*a*. Thus, dismounting of the toner container 4*a* to 4*d* is restrained.

Figure 11:
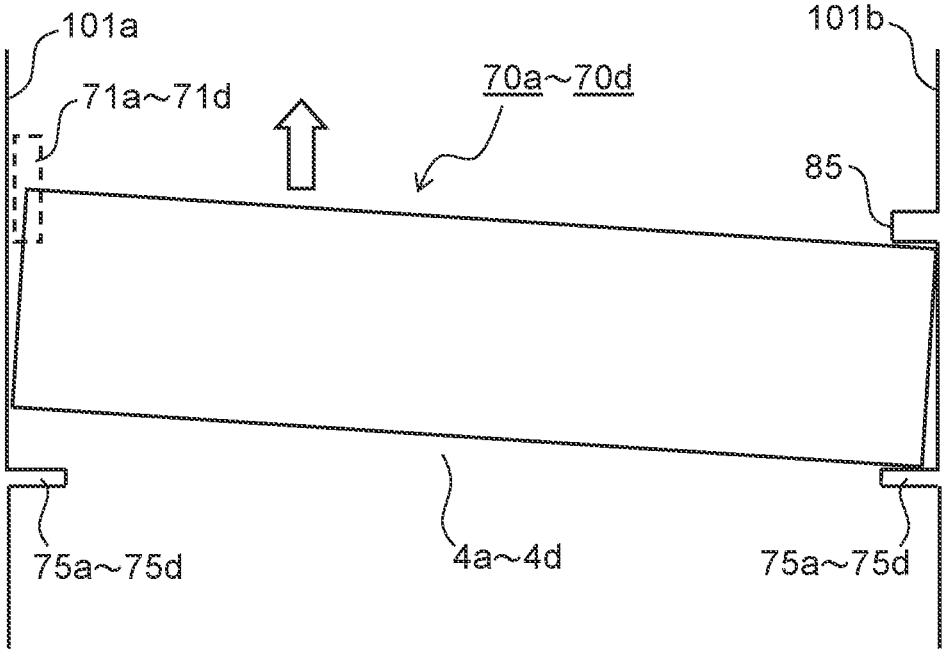
FIG. 11 is a side view schematically showing how the toner containers are dismounted from the state in FIG. 10.

An empty toner container 4*a* to 4*d* is replaced in the following manner. The solenoid 57*a* to 57*d* is energized so that the locking member 71*a* to 71*d* swings from the first position to the second position. Now, dismounting of the toner container 4*a* to 4*d* is allowed. A serviceperson lifts up the rear frame 101*a* side (left side in FIG. 11) of the toner container 4*a* to 4*d* to take it out from between the bottom support portion 75*a* to 75*d* and the stopper 85. In this way, the toner containers 4*a* to 4*d* can be taken out of the first to fourth mount portions 70*a* to 70*d*.

A new toner container 4*a* to 4*d* is mounted in the following manner. First, the front frame 101*b* side of the toner container 4*a* to 4*d* is inserted between the bottom support portion 75*a* to 75*d* and the stopper 85. Then, the rear frame 101*a* side of the toner container 4*a* to 4*d* is mounted in the first to fourth mount portion 70*a* to 70*d* along the locking members 71*a* to 71*d* and the side support rail 73*b* to 73*ezon*. Lastly, the locking member 71*a* to 71*d* is manually swung from the second position to the first position, and this completes the replacement of the toner container 4*a* to 4*d*.

As shown in FIG. 8, when the locking members 71*a* to 71*d* are in the second position, they stand upright on the extension lines of the side support rails 73*a* to 73*e*. This permits the toner containers 4*a* to 4*d*, when mounted in and dismounted from the first to fourth mount portions 70*a* to 70*d*, to be taken out and inserted smoothly along the side support rails 73*a* to 73*e* and the locking members 71*a* to 71*d*. Thus, the locking members 71*a* to 71*d* function as parts of rail members during mounting and dismounting of the toner containers 4*a* to 4*d* in and from the first to fourth mount portions 70*a* to 70*d*.

Moreover, when the locking members 71*a* to 71*d* are in the second position, as shown in FIG. 8, their tip end portions protrude upward out of the rear frame 101*a*, and this prevents the top cover 17*a* from being closed completely. This eliminates the likelihood of, after mounting the toner containers 4*a* to 4*d*, the user forgetting to operate the locking members 71*a* to 71*d* to move them back to the first position. With a configuration where, when the top cover 17*a* is pressed with hands to be completely closed, the locking members 71*a* to 71*d* swing to the first position, it is possible to omit the need to operate the locking members 71*a* to 71*d* individually to swing them to the first position.

Figure 12:
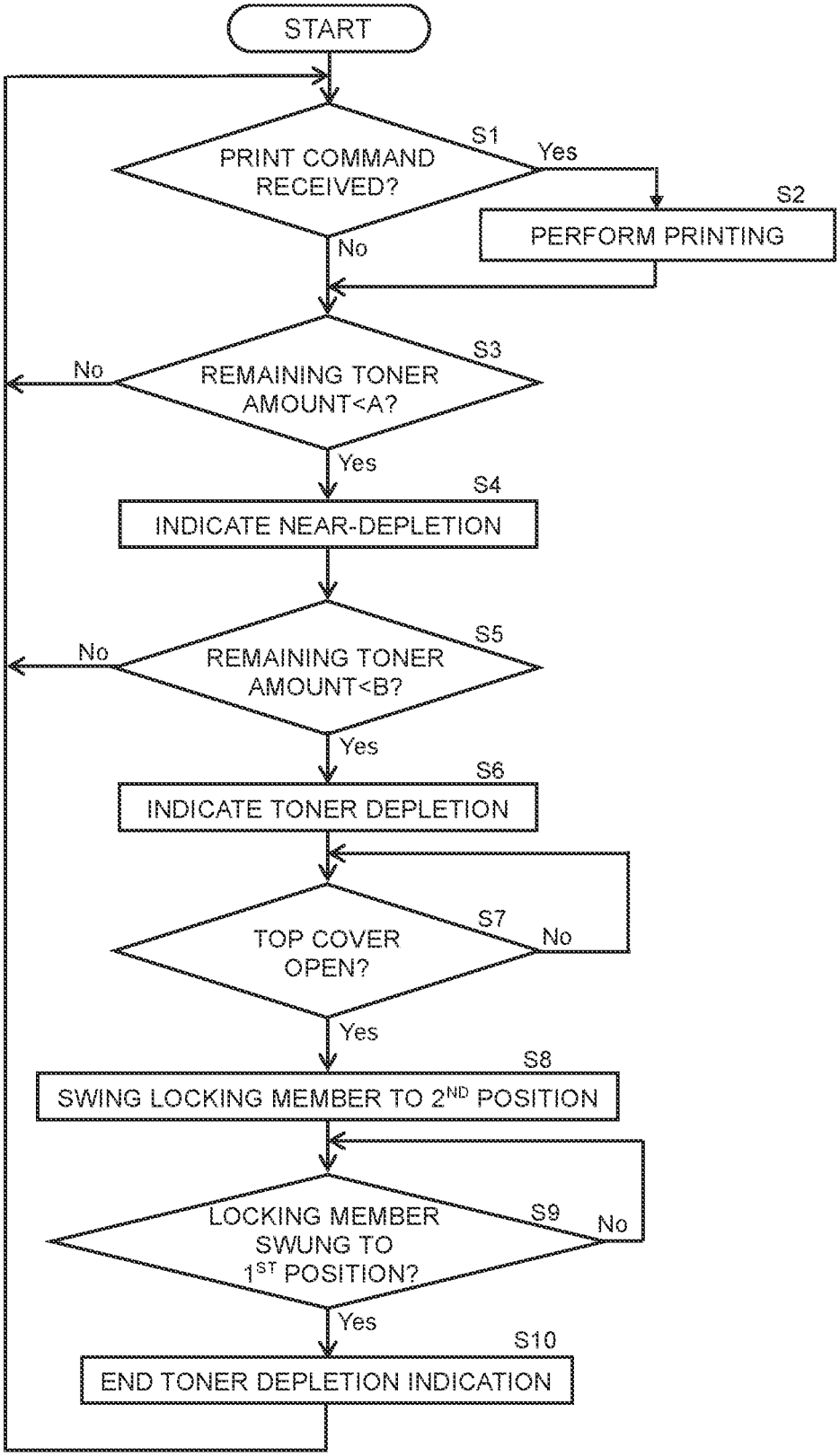
FIG. 12 is a flow chart showing a procedure for replacing toner containers in the image forming apparatus according to the embodiment.

FIG. 12 is a flow chart showing a procedure for replacing the toner containers 4*a* to 4*d* in the image forming apparatus 100 according to the embodiment. The procedure for replacing the toner containers 4*a* to 4*d* will now be described along the steps in FIG. 12 with reference also to FIGS. 1 to 11 as well as FIG. 13, which will be described later.

First, the control portion 90 checks whether a print command is received (Step S1). If a print command is received (Step S1, Yes), printing is performed through ordinary image forming operation (Step S2). If no print command is received (Step S1, No), the control portion 90 checks whether the remaining toner amount in the toner containers 4*a* to 4*d* as sensed by the remaining toner amount sensing portion 56 is less than a threshold value A (Step S3).

If the remaining toner amount is equal to or more than A (Step S3, No), a return is made to Step S1, where a transition is made to a standby state waiting for a print command. If the remaining toner amount in any of the toner containers 4*a* to 4*d* is less than A (Step S3, Yes), that one of the toner containers 4*a* to 4*d* is estimated to be close to empty; thus, on the liquid crystal display portion 61, a message alerting the user to "near-depletion" in the toner container 4*a* to 4*d* in question is displayed (Step S4).

Next, the control portion 90 checks whether the remaining toner amount in the toner containers 4*a* to 4*d* as sensed by the remaining toner amount sensing portion 56 is less than a threshold value B (B<A) (Step S5). If the remaining toner amount is equal to or more than B (Step S5, No), a return is made to Step S1, where a transition is made to the standby state waiting for a print command. If the remaining toner amount in any of the toner containers 4*a* to 4*d* is less than B (Step S5, Yes), that one of the toner containers 4*a* to 4*d* is estimated to be empty; thus, the control portion 90 displays, on the liquid crystal display portion 61, a message alerting the user to "toner depletion" in the toner container 4*a* to 4*d* in question (Step S6).

Next, the control portion 90 checks, based on a sense signal from the open-close sensing switch 63, whether the top cover 17*a* is opened (Step S7). If the top cover 17*a* is opened (Step S7, Yes), a control signal is transmitted to one of the solenoids 57*a* to 57*d*, thereby to make the locking member 71*a* to 71*d* of the toner container 4*a* to 4*d* corresponding to that one of the toner containers 4*a* to 4*d* which has been found to be empty swing from the first position to the second position (Step S8).

Figure 13:
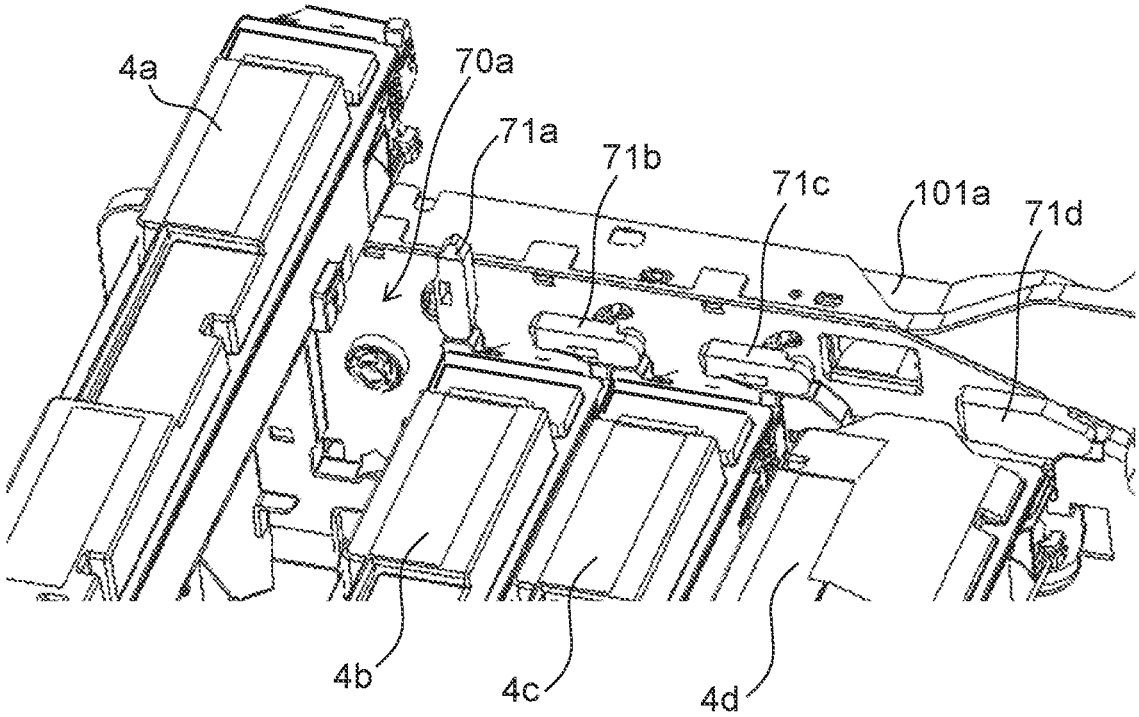
FIG. 13 is a perspective view showing the structure of the toner container mount portion at its rear frame side, showing how a toner container is replaced.

For example, when the remaining toner amount in the toner container 4*a* is less than B, only the locking member 71*a* is swung to the second position. As a result, as shown in FIG. 13, the toner container 4*a* can now be mounted in or dismounted from the first mount portion 70*a*. On the other hand, the lock members 71*b* to 71*d* are kept in the first position, and thus dismounting of the toner containers 4*b* to 4*d* is restrained.

Next, the control portion 90 checks whether the locking member 71*a* to 71*d*, which was swung to the second position in Step S8, has swung to the first position (Step S9). If it has not swung to the first position (Step S9, No), the corresponding toner container 4*a* to 4*d* is estimated either not to have been replaced yet or to have been replaced but left unlocked by the locking member 71*a* to 71*d*. Accordingly, on the liquid crystal display portion 61, toner depletion continues to be indicated.

If the locking member 71*a* to 71*d* has been swung to the first position (Step S9, Yes), the corresponding toner container 4*a* to 4*d* has been replaced and locked, thus toner depletion ceases to be indicated (Step S10). Then a return is made to Step S1, where a transition is made to the standby state waiting for a print command.

With a configuration according to the present disclosure, when the locking member 71*a* to 71*d* is in the second position, it stands upright on the extension line of the side support rail 73*b* to 73*e*. That is, the locking member 71*a* to 71*d* and the corresponding side support rail 73*b* to 73*e* are arranged in a straight line. Thus, the locking member 71*a* to 71*d* together with the side support rail 73*b* to 73*e* functions as a rail member during mounting and dismounting of the toner container 4*a* to 4*d*, and this allows smooth replacement of the toner container 4*a* to 4*d*.

The locking member 71*a* to 71*d* overlaps only a rear frame 101*a* side part of the toner container 4*a* to 4*d*. This helps make the locking member 71*a* to 71*d* more compact than ever, and is particularly advantageous in a construction where the toner container 4*a* to 4*d* is mounted and dismounted from above the container mount portion 70.

When the locking member 71*a* to 71*d* is in the second position, the tip end of the locking member 71*a* to 71*d* protrudes upward out of the rear frame 101*a* and the front frame 101*b*, and prevents the top cover 17*a* (see FIG. 1) from being closed. This prevents the user from forgetting to lock the toner container 4*a* to 4*d*

With the procedure for replacement shown in FIG. 12, only the locking member 71*a* to 71*d* corresponding to whichever of the toner containers 4*a* to 4*d* needs to be replaced swings to the second position to release the locked state. This prevents a toner container 4*a* to 4*d* that does not need to be replaced from being replaced by mistake.

It is only after the top cover 17*a* is confirmed to be open that the locking member 71*a* to 71*d* is swung from the first position to the second position. This helps prevent the locking member 71*a* to 71*d* from colliding with the top cover 17*a*. It is thus possible to prevent collision noise and destruction of the locking member 71*a* to 71*d* or the lock release driving portion 80.

The present disclosure is not limited by the embodiments described above and allows for many modifications without departing from the spirit of the present disclosure. For example, the materials, shapes, arrangements, and the like of components specifically described above are merely illustrative and are not meant to limit the scope of the present disclosure to them unless particularly specified.

For example, in the embodiment described above, when, despite toner being supplied, the toner concentration in the developer holder 20 as sensed by the toner concentration sensor 23 does not rise, the toner container 4*a* to 4*d* is judged to be empty of toner (toner depletion). Instead, there may be provided a remaining toner amount sensor that directly senses the remaining toner amount in the toner container 4*a* to 4*d*.

In the embodiment described above, the locking members 71*a* to 71*d* are provided adjacent to, respectively, one of the pair of side support rails 73*a* and 73*b* provided in the first mount portion 70*a*, one of the pair of side support rails 73*b* and 73*c* provided in the second mount portion 70*b*, one of the pair of side support rails 73*c* and 73*d* provided in the third mount portion 70*c*, and one of the pair of side support rails 73*d* and 73*e* provided in the fourth mount portion 70*d*. Instead, for example, the locking members 71*a* may be provided adjacent to each of the pair side support rails 73*a* and 73*b* provided in the first mount portion 70*a*.

Needless to say, the present disclosure is applicable not only to color printers like the one shown in FIG. 1 but to various image forming apparatuses including a replaceable toner holder, such as monochrome printers, monochrome multifunction peripherals, rotary or tandem color copiers and facsimile machines.

The present disclosure finds applications in image forming apparatuses that incorporate a toner holder which is dismountably mounted in the body of the image forming apparatus. Based on the present disclosure, it is possible to provide an image forming apparatus that allows mounting and dismounting of only a toner holder that needs to be replaced and that allows easy mounting and dismounting of a toner holder.

What is claimed is:

1. An image forming apparatus, comprising:

an image carrying member on which an electrostatic latent image is formed;

a developing device that forms a toner image by attaching toner to the electrostatic latent image formed on the image carrying member;

a toner holder that is dismountably mounted and that stores the toner to be supplied to the developing device;

a toner holder mount portion in which the toner holder is mounted; and a locking member that restrains mounting and dismounting of the toner holder in and from the toner holder mount portion, wherein the toner holder mount portion has a pair of side support rails that supports a side face of the toner holder, the locking member is arranged adjacent to an upstream end part, in a mounting direction of the toner holder, of at least one of the pair of side support rails, the locking member being swingable between a first position where the locking member is perpendicular to an extension direction of the side support rails and restrains mounting and dismounting of the toner holder and a second position where the locking member is parallel to the extension direction of the side support rails and allows mounting and dismounting of the toner holder, the locking member, when in the second position, is arranged on an extension line of the side support rails and guides, together with the side support rails, the toner holder to and from the toner holder mount portion, the toner holder mount portion is formed between a pair of frames arranged opposite each other, and the pair of side support rails is supported by the pair of frames respectively, and the locking member swings between the first and second positions along at least one of the pair of frames.

2. The image forming apparatus according to claim 1, wherein the toner holder can be mounted in and dismounted from the toner holder mount portion from above, the side support rails are supported substantially vertical along the pair of frames, and the locking member is arranged adjacent to a top end part of one of the pair of side support rails.

3. The image forming apparatus according to claim 2, further comprising:

a top cover that covers over the toner holder mount portion and that can be opened and closed, wherein the locking member, when in the second position, protrudes upward beyond a closed position of the top cover.

4. The image forming apparatus according to claim 3, wherein the locking member swings from the second position to the first position as the top cover is closed.

5. The image forming apparatus according to claim 3, further comprising:

an open-close sensing switch that senses whether the top cover is open or closed;

a lock release driving portion that releases a restrained state by the locking member; and a control portion that controls the lock release driving portion, wherein when the open-close sensing switch senses the top cover being opened, the control portion controls such that the lock release driving portion makes the locking member swing to the second position.

6. An image forming apparatus, comprising:

an image carrying member on which an electrostatic latent image is formed;

a developing device that forms a toner image by attaching toner to the electrostatic latent image formed on the image carrying member;

a toner holder that is dismountably mounted and that stores the toner to be supplied to the developing device;

a toner holder mount portion in which the toner holder is mounted; and a locking member that restrains mounting and dismounting of the toner holder in and from the toner holder mount portion, wherein the toner holder mount portion has a pair of side support rails that supports a side face of the toner holder, the locking member is arranged adjacent to an upstream end part, in a mounting direction of the toner holder, of at least one of the pair of side support rails, the locking member being swingable between a first position where the locking member is perpendicular to an extension direction of the side support rails and restrains mounting and dismounting of the toner holder and a second position where the locking member is parallel to the extension direction of the side support rails and allows mounting and dismounting of the toner holder, the locking member, when in the second position, is arranged on an extension line of the side support rails and guides, together with the side support rails, the toner holder to and from the toner holder mount portion, the image forming apparatus further comprises:

a remaining toner amount sensing portion that can detect a toner depletion state where a remaining toner amount in the toner holder is equal to or less than a predetermined amount;

a lock release driving portion that releases a restrained state by the locking member; and a control portion that controls the lock release driving portion, wherein when the remaining toner amount sensing portion detects the toner depletion state, the control portion controls such that the lock release driving portion makes the locking member swing to the second position, and the lock release driving portion includes:

a biasing member that biases the locking member toward the second position;

a link member swingable and having a hook portion that engages with an engagement projection on the locking member, wherein, with the hook portion engaged with the engagement projection, the link member keeps the locking member in the first position; and a solenoid having a plunger coupled to the link member, wherein, as the plunger is pulled in, the solenoid disengages the hook portion from the engagement projection.

7. The mage forming apparatus according to claim 6, further comprising:

a plurality of the developing devices that form the toner images of different colors on a plurality of the image carrying members; and a plurality of the toner holders that store the toner of different colors to be supplied to the plurality of the developing devices, wherein when the remaining toner amount sensing portion detects the toner depletion state in any of the toner holders, the control portion makes only the locking member that restrains mounting and dismounting of the toner holder in which the toner depletion state has been detected swing to the second position.

8. The image forming apparatus according to claim 6, further comprising:

a display portion that indicates the toner depletion state detected by the remaining toner amount sensing portion, wherein when the locking member swings from the second position to the first position, the control portion ends indication of the toner depletion state by the display portion.

* * * * *